US005231807A

United States Patent [19]

Aymes

[11] Patent Number: 5,231,807

[45] Date of Patent: Aug. 3, 1993

[54] SWIMMING POOL SUPPORT STRUCTURE

[76] Inventor: Doniel G. Aymes, P.O. Box 1783, New Brunswick, N.J. 08902

[21] Appl. No.: 615,459

[22] Filed: Nov. 19, 1990

[51] Int. Cl.[5] ..... E04H 4/04; E04B 1/344; E04C 3/00

[52] U.S. Cl. ..... 52/65; 52/71; 52/105; 52/245; 52/169.8; 52/300; 52/721; 4/506

[58] Field of Search ..... 52/169.7, 169.8, 245, 52/261, 71, 247, 265, 300, 65, 105, 720, 721, 725, 727; 4/506

[56] References Cited

U.S. PATENT DOCUMENTS

| | | | |
|---|---|---|---|
| 820,156 | 5/1906 | Tresidder | 52/725 X |
| 3,233,251 | 2/1966 | Barrera | 52/265 |
| 3,268,917 | 8/1966 | Diemond et al. | 52/245 |
| 3,518,705 | 7/1970 | Cudney | 52/169.7 |
| 3,530,512 | 9/1970 | McBride | 52/169.7 X |
| 3,745,593 | 7/1973 | Wall | 52/300 X |
| 3,793,651 | 2/1974 | Pitti et al. | 52/300 X |
| 3,874,132 | 4/1975 | Mendelow et al. | 52/71 |
| 4,023,217 | 5/1977 | Kessler | 52/169.7 X |
| 4,062,158 | 12/1977 | Kaufmann et al. | 52/71 |
| 5,054,135 | 10/1991 | Dalloure et al. | 52/71 X |

*Primary Examiner*—Carl D. Friedman
*Assistant Examiner*—Robert J. Canfield
*Attorney, Agent, or Firm*—R. Neil Sudol; Henry D. Coleman

[57] ABSTRACT

A swimming pool support structure comprises an elongate upright member having a longitudinal axis and a pivot attached at least indirectly to the upright member at one end thereof for defining an axis of rotation extending in a direction parallel to the longitudinal axis. An elongate top rail member is provided at an end with a connector for pivotably connecting the top rail member to the upright member at the pivot, while a fastener is provided for fixing the top rail member to the upright member upon the attainment of a desired orientation angle of the top rail member with respect to the upright member. A swimming pool incorporating the support structure is installed by erecting a first upright member at a predetermined location, pivotally attaching a first end of a first top rail member to the pivot pin of that first upright member, rotating the top rail member about the pivot pin until a first desired angle of orientation is attained between the top rail member and the bearing plate of the upright member. Upon attainment of the desired angle of orientation, the top rail member is fastened to the bearing plate. Subsequently, the free end of the first top rail member 24 is connected to a second upright member. The procedure is then repeated with a second top rail member and then a third upright member.

32 Claims, 13 Drawing Sheets

SWIMMING POOL SUPPORT STRUCTURE

FIELD OF THE INVENTION

This invention relates to above-ground swimming pools. More particularly, this invention relates to a structure for supporting the wall of an above-ground swimming pool. The invention also relates to a method for installing an above-ground swimming pool which utilizes the support structure. The invention also relates to a cap for an upright member of the swimming pool support structure.

BACKGROUND OF THE INVENTION

An above-ground swimming pool generally comprises an elongate strip of metal which forms the vertical wall of the pool. The wall is supported by a plurality of upright members which are equispaced about the circumference of the pool. A horizontal bar or a plurality of bars supporting the pool wall along its upper edge extend between adjacent uprights. The horizontal bars are attached to the upright members and are provided on their undersides with grooves for receiving the top edge of the pool wall. Also connected to the upright members at the upper ends thereof are a plurality of top rail members each having an upper surface of at least several inches.

Generally, the upright members of conventional swimming pool support structures are provided with ornamental strips. These strips can be interchanged with geometrically similar strips bearing different two-dimensional designs or color schemes, whereby the swimming pool support structures can be provided with a different aesthetic aspect. Clearly, the decorative changes permitted in conventional pools is severely limited by the structural design of the pools.

OBJECTS OF THE INVENTION

An object of the present invention is to provide an improved support structure for above-ground swimming pools.

Another, more particular, object of the present invention is to provide such a support structure which facilitates pool installation.

Another particular object of the present invention is to provide such a support structure in which ornamentation is more easily separable from support functions than in conventional pool support structures.

A further particular object of the present invention is to provide such a support structure which facilitates modification of ornamental features.

Yet another object of the present invention is to provide an improved method for installing an above-ground swimming pool.

SUMMARY OF THE INVENTION

A swimming pool support structure comprises, in accordance with the present invention, an elongate upright member having a longitudinal axis and a pivot attached at least indirectly to the upright member at one end thereof for defining an axis of rotation extending in a direction parallel to the longitudinal axis. The support structure further comprises an elongate top rail member provided at an end with a connector for pivotably connecting the top rail member to the upright member at the pivot. A fastener is provided for fixing the top rail member to the upright member upon the attainment of a desired orientation angle of the top rail member with respect to the upright member.

Pursuant to another feature of the present invention, the support structure further comprises a horizontal support for providing a horizontally oriented support surface, the support being attached to the upright member. Specifically, the horizontal support takes the form of a bearing plate attached to one end of the upright member, the bearing plate extending essentially orthogonally with respect to the axis of the upright member.

Pursuant to further features of the present invention, the pivot takes the form of a pivot pin attached at least indirectly to the upright member at the bearing plate, while the connector takes the form of a hole having a diameter greater than a diameter of the pin, the pin traversing the hole so that the top rail member is pivotably attached to the upright member at the pin.

Pursuant to yet another feature of the present invention, the top rail member is formed on an underside with a network of ribs. The top rail member has a central region extending essentially along the length of the member, the ribs in the central region being smaller in width than ribs outside the central region, whereby swimming pool side walls of different diameters may be accommodated.

Accordingly, a swimming pool support structure in accordance with the present invention comprises an elongate upright member having a longitudinal axis and a bearing plate member attached to one end of the upright member, the bearing plate member extending essentially orthogonally with respect to the axis. A pivot pin is attached at least indirectly to the upright member at the bearing plate and extends in a direction parallel to the axis. An elongate top rail member is provided at opposite ends with a pair of holes each having a diameter greater than a diameter of the pin, the pin traversing one of the holes so that the top rail member is pivotably attached to the upright member at the pin. A fastener is provided for fixing the top rail member to the upright member upon the attainment of a desired orientation angle of the top rail member with respect to the bearing plate.

Pursuant to a specific feature of the present invention, the bearing plate constitutes an upper bearing plate. The swimming pool support structure further comprises a lower bearing plate and a hollow foot member attached to an end of the upright member opposite the upper bearing plate, the lower bearing plate being disposed inside the hollow foot member. In order to enable the support structure to be used with oval pools as well as circular pools, the foot member is provided with a cutout or slot traversable by a strap member.

Pursuant to another specific feature of the present invention, the upright member includes a hollow casing and the support structure further comprises a head section and a foot section each attached to the casing and forming a continuous outer surface therewith. The upper bearing plate is mounted in the head section. The support structure further comprises a cap member releasably attached to the head section to form a continuous outer surface therewith. In accordance with the present invention, the head section and the foot section are detachably connected to the casing. In addition or alternatively, attachment elements may be provided for releasably attaching the cap member to the head section, those attachment elements including mating projections on the cap member and the bearing plate. Preferably, one of the mating projections is constituted by the pin.

The fastener for securing the top rail member to the upright member preferably takes the form of an elongate elements such as a bolt traversing a slot on one of the upper bearing plate and the top rail member and an aperture on the other of the upper bearing plate and the top rail member.

Pursuant to yet another specific feature of the present invention, markers are provided on the upper bearing plate for facilitating selection of the orientation angle in accordance with a desired pool size. Preferably, the markers include linear marker elements on the upper bearing plate.

Pursuant to an additional feature of the present invention, the top rail member is provided at the opposite ends with circularly arcuate edge portions, while the cap member is provided with a circularly arcuate inner surface having a radius larger than a common radius of the edge portions.

In accordance with another particular embodiment of the present invention, the upright member includes a hollow decorative casing preferably made of polymeric material and a load-bearing member disposed inside the casing. A foot member is attached to the casing at one end thereof and forms a continuous outer surface therewith. In addition, a head member is attached to the casing at an end thereof opposite the foot member, the head member forming a continuous outer surface with the casing. A first bearing plate is disposed inside the foot member, while a second bearing plate is disposed inside the head member. A cap member is releasably attached to the head member to form a continuous external surface therewith, the cap member covering the second bearing plate.

As discussed hereinabove, the second bearing plate is provided with a bearing pin for enabling attachment of a swimming pool top rail member to the bearing plate at a selectable orientation angle with respect to the bearing plate. In addition, markers are provided on the second bearing plate for facilitating the selection of the orientation angle in accordance with a desired pool size, whereas a fastener is provided for fixing the top rail member to the upright upon the attainment of a selected orientation angle of the top rail member with respect to the bearing plate.

A cap member for a swimming pool support structure comprises, in accordance with the present invention, a hollow half shell molded to have an outer surface with an essentially ornamental shape and a projection extending from a first inner surface of the shell in a region about one end of the shell. The shell is provided at an end opposite the one end with a substantially cylindrical second inner surface continuous with the first inner surface and having an axis of curvature substantially coaxial with the projection. Attachment elements are formed on the shell for releasably attaching it to another half shell on a swimming pool upright support.

Pursuant to another feature of the present invention, the cap member includes, at a location on the first inner surface spaced from the projection, an additional projection extending substantially parallel to the axis of curvature of the second inner surface of the half shell.

A method of installing an above-ground swimming pool comprises, in accordance with the present invention, the steps of (a) erecting a first upright member having a first bearing plate at an upper end and a first pivot pin attached to the bearing plate, (b) pivotally attaching a first end of a first top rail member to the pivot pin, and (c) rotating the top rail member about the pivot pin until a first desired angle of orientation is attained between the top rail member and the bearing plate. Upon attainment of the angle of orientation, the top rail member is fastened to the bearing plate. In a subsequent sequence of steps, another upright member is erected at a second end of the top rail member opposite the first end, and the second end is fastened to the second upright member at a second pivot pin attached to a second bearing plate in turn attached to the second upright member. A first end of a second top rail member is then pivotably mounted to the second pivot pin, whereupon the second top rail member is rotated about the second pivot pin until a second desired angle of orientation is attained between the second top rail member and the second bearing plate. Upon attainment of the second desired angle of orientation, the second top rail member is fastened to the second bearing plate.

A swimming pool support structure in accordance with the present invention facilitates and simplifies pool installation. In addition, the three dimensional appearance of the swimming pool support structure is more easily separable from support functions than in conventional pool support structures. This separation facilitates modification of ornamental features so that swimming pools utilizing the support structure of the invention can be easily modified to assume a vastly different look.

A swimming pool support structure in accordance with the invention is of a modular design in that it can be used to install pools of different sizes.

DETAILED DESCRIPTION

Figure 1:
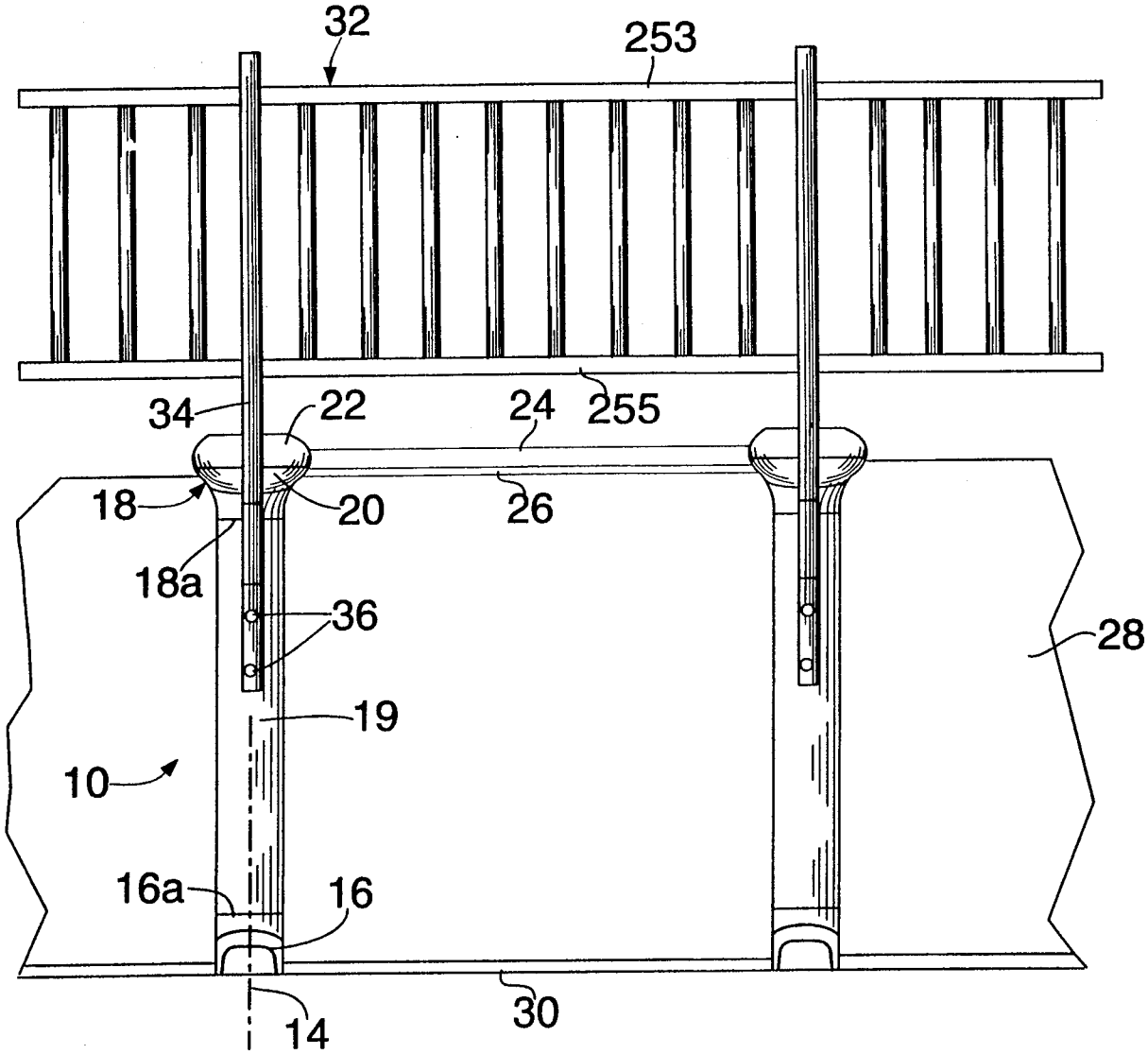
FIG. 1 is a partially schematic side elevational view of a swimming pool with a swimming pool support structure in accordance with the present invention.

As illustrated in FIG. 1, a swimming pool support structure 10 comprises an elongate upright member 12 having a longitudinal axis 14. Upright member 12 is provided with a foot portion or section 16 and a head portion or section 18 disposed at opposite ends of a straight main body 19. Foot portion 16 and head portion 18 may be detachably connected to main body 19 along respective joints 16*a* and 18*a*.

Head portion 18 includes a base 20 and a cap 22 detachably mounted thereto. As indicated schematically in FIG. 1, foot portion 16 and head portion 18 are formed with a rounded aspect to provide a decorative appearance.

Swimming pool support structure 10 further comprises a top rail member 24. Top rail member 24 extends between two upright members 12 above an arcuate upper support bar or rod 26 provided on a lower side with a longitudinally extending groove (not illustrated) which receives the upper edge of a swimming pool wall 28.

An arcuate lower support bar or rod 30 extends between upright members 12 along a bottom edge of pool wall 28. Bar 30 is provided with in an upper surface with a longitudinally extending groove (not illustrated) for receiving the lower edge of pool wall 28.

An optional feature of swimming pool support structure 10 comprises a swimming pool railing 32. Railing 32 includes posts 34 each attached by one or more bolts 36 to respective upright members 12.

It is to be understood that upright members 12 are angularly equispaced about the perimeter of a circular pool and support pool wall 28 in a circular configuration. It is to be noted, however, that the principles of the instant invention are also applicable to oval pools, provision being made in swimming pool support structure 10 and particularly in foot portion 16, as described in detail hereinafter, for receiving strap members for maintaining a pool in an oval configuration.

Figure 2:
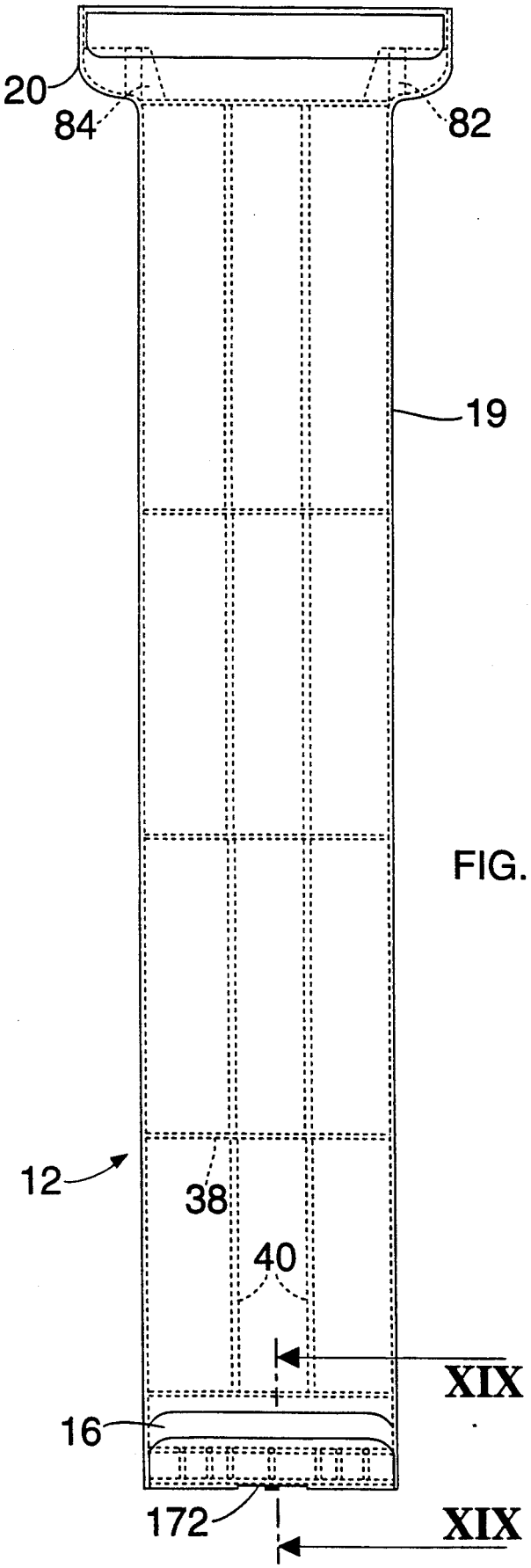
FIG. 2 is a front elevational view of an upright member forming a component part of the swimming pool support structure of FIG. 1.

FIG. 2 is an elevational front view of upright member 12, including foot portion 16 and base 20 of head portion 18. As shown in FIG. 2, main body 19 of upright member 12 is provided internally with horizontal and vertical reinforcement plates 38 and 40.

Figure 3:
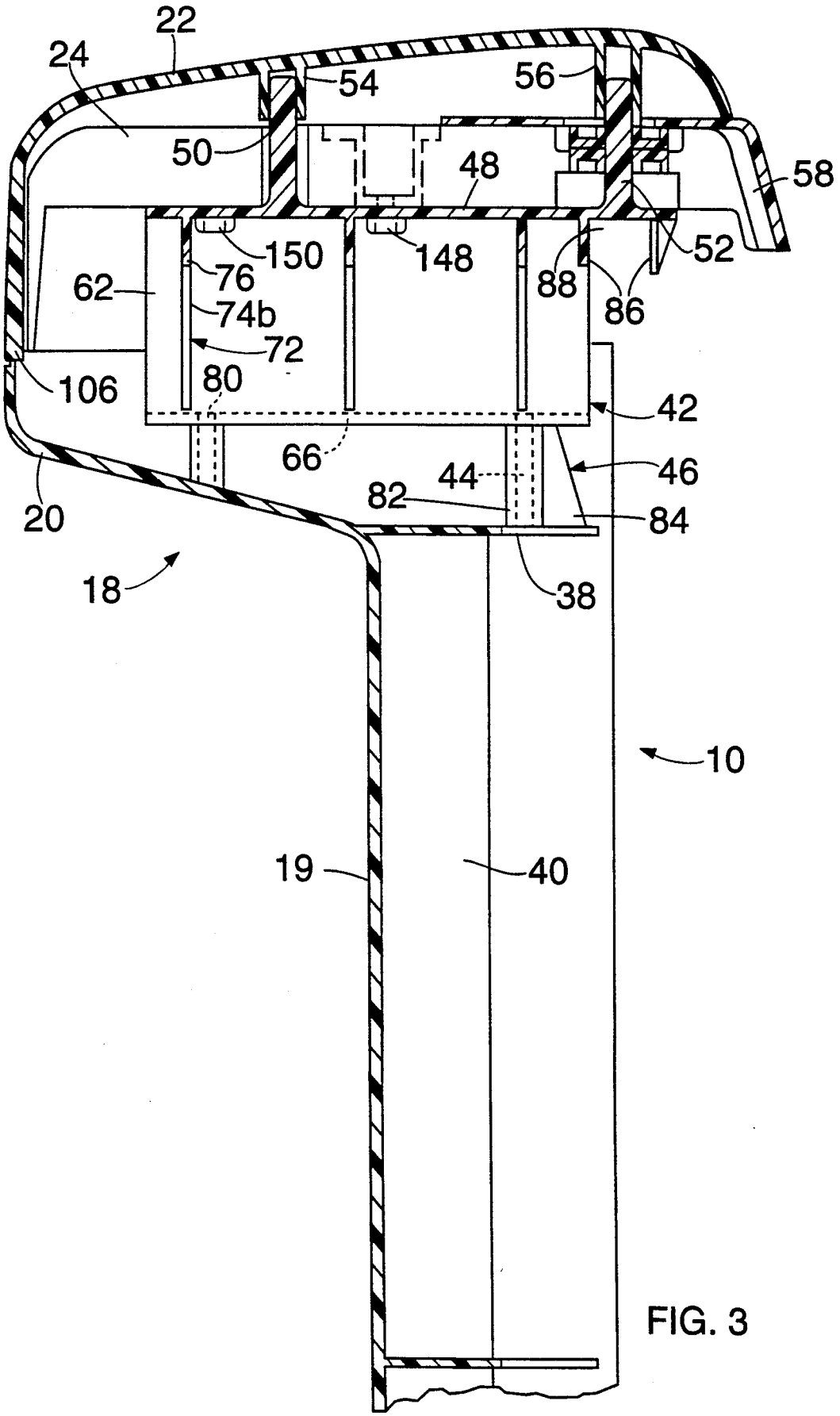
FIG. 3 is a partial cross-sectional view taken along a vertical plane incorporating a longitudinal axis of the swimming pool support structure in FIG. 1.

FIG. 3 is a longitudinal cross-sectional view of the upper end of upright member 12, particularly including head portion 18, base 20, cap 22, and top rail member 24. As shown in FIG. 3, main body 19 of upright member 12 takes the form of a shell, open towards the rear, i.e., towards pool wall 28 and the pool center. Similarly, base 20 and cap 22 of head portion 18 are hollow parts with outer surfaces which form a continuous molded contour or profile with main body 19.

As depicted in FIG. 3, head portion 18 includes a bearing member 42 secured by schematically indicated bolts 44 to a support assembly 46 in turn attached to a horizontal reinforcement plate 38. Bearing member 42 includes an upper plate 48 provided with a pair of vertically projecting lugs 50 and 52. Lug 52 serves as a pivot pin for attaching a pair of top rail members 24 (see FIG. 18) to upright member 12 and additionally enables a mounting of cap 22 to base 20 to form a completed head portion 18. Lug 50 and pivot pin 52 are male connectors which are matingly inserted in a snap-lock type fit into respective female projections or sleeves 54 and 56 on the inner surface of cap 22, whereby cap 22 is removably attached to base 20 of head portion 18. For purposes of facilitating the snap lock connection of lug 50 and pivot pin 52 to sleeves 54 and 56, those elements may be provided on their contacting surface with interlocking grooves and beads (not illustrated).

As also depicted in FIG. 3, head portion 18 incorporates a visor-shaped protective member 58 described in greater detail hereinafter with reference to FIGS. 9 and 10.

Figure 4:
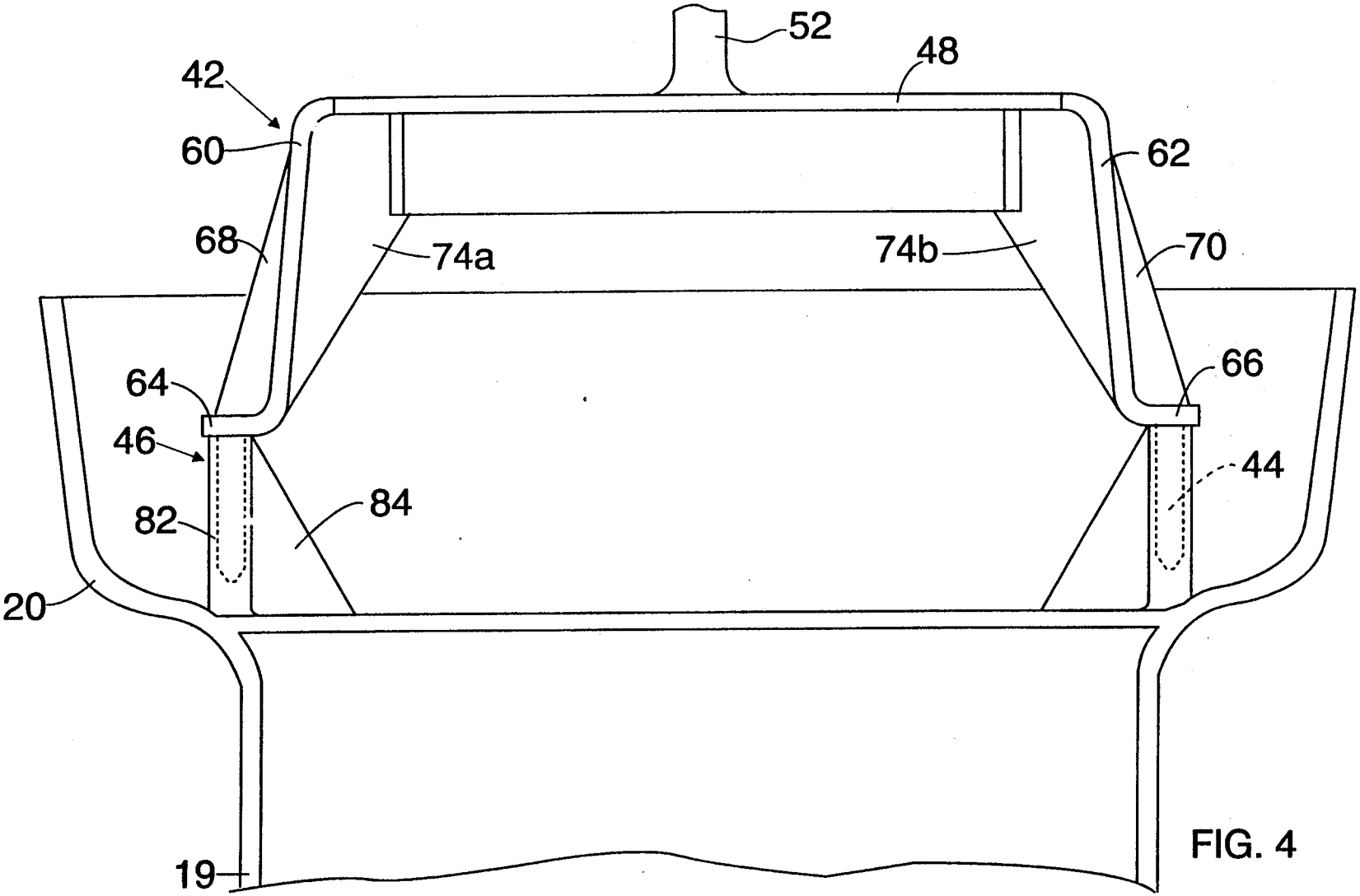
FIG. 4 is a partial rear elevational view of the upright member of FIGS. 1 and 2, showing in detail a bearing member and a support frame incorporated in a head portion of the upright member.
Figure 5:
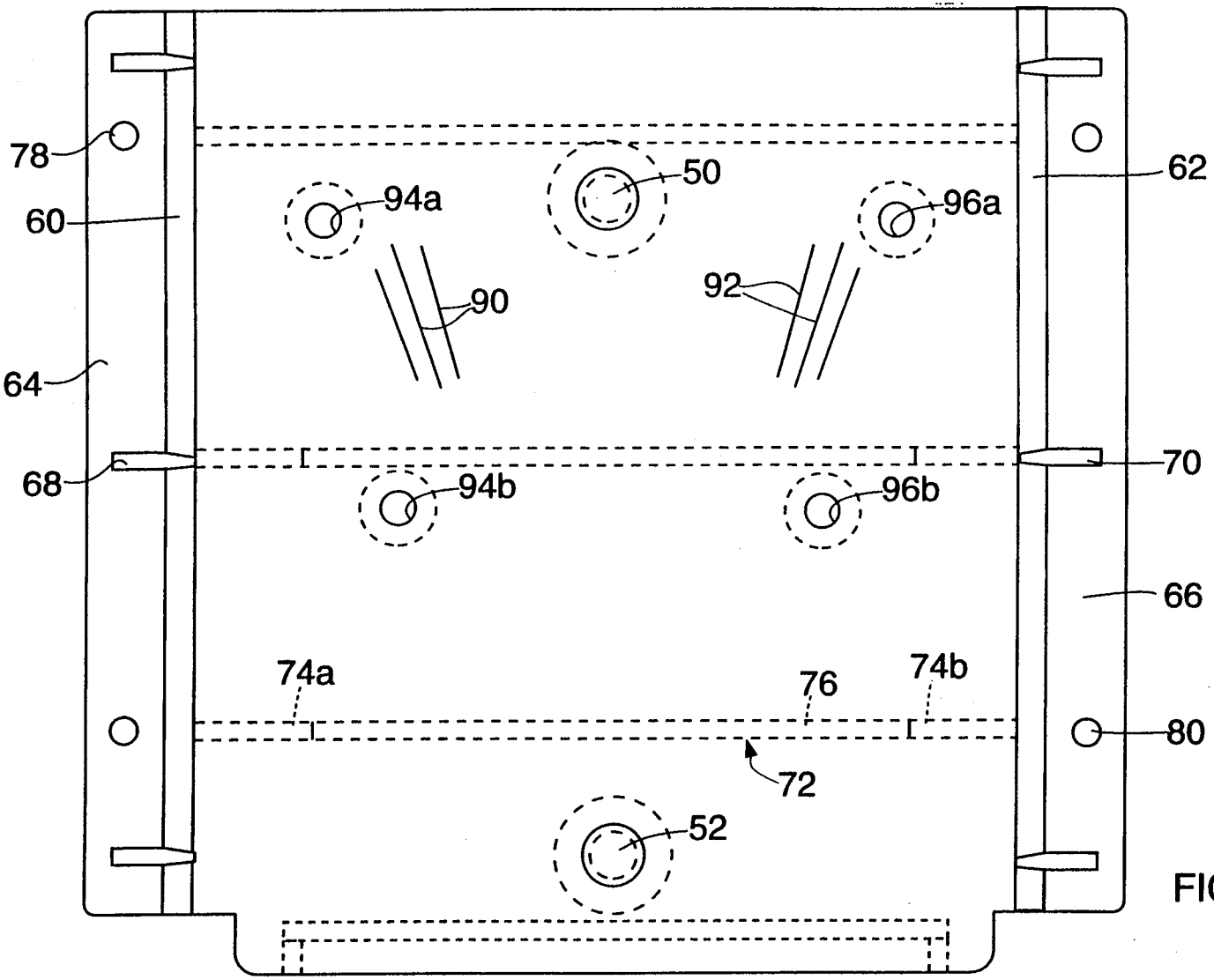
FIG. 5 is a top view of the bearing member of FIGS. 2 and 4.

As illustrated in FIGS. 4 and 5, bearing member 38 has a U or channel shape and comprises a horizontal upper plate 48 integral along opposite edges with two vertical leg plates 60 and 62 in turn rigid along their lower edges with two outwardly turned foot plates or flanges 64 and 66. Flanges 64 and 66 are reinforced in their connection to leg plates 60 and 62 by respectively pluralities of tapered triangular buttresses 68 and 70 spaced from each other along the lengths of the respective flanges 64 and 66. In addition, the connection of leg plates 60 and 62 to upper bearing plate 48 is reinforced by a plurality of ribs 72 each including a pair of tapered triangular buttresses 74*a* and 74*b* connected by a central web 76.

Flanges 64 and 66 of bearing member 38 are provided with holes 78 and 80 which are traversed by bolts 44 received in cylindrical components 82 of support assembly 46. Cylindrical components 82 are rigid with a horizontal reinforcement plate 38 and are supported in their connection thereto by triangular buttress components 84.

As shown in FIGS. 3 and 4, bearing member 38 is formed on a lower surface of upper plate 48 with a pair of elongate webs 86 which define a channel 88 for receiving upper support bar 26.

As shown in FIG. 5, an upper horizontally oriented support surface of upper bearing plate 48 has two arrays of inscribed or painted line segments 90 and 92 which are approximately radially oriented with respect to pivot pin 52. Line segments 90 and 92 may be associated with respective symbols on the upper surface of bearing plate 48 indicating that the line segments are to be used in the construction of pools of different sizes, as described in greater detail hereinafter.

Upper bearing plate 48 is also formed with two or more pairs of bores 94*a*, 94*b* and 96*a*, 96*b* which may be internally threaded, for receiving bolt fasteners.

Figure 7:
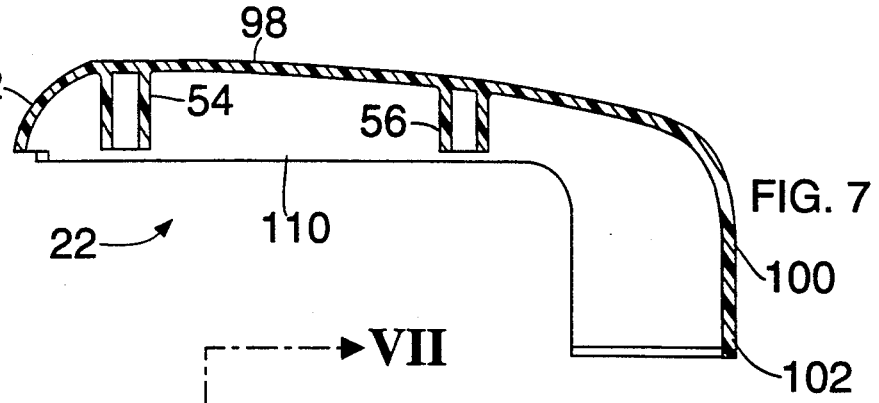
FIG. 7 is a cross-sectional view taken along line VII—VII in FIG. 6.
Figure 6:
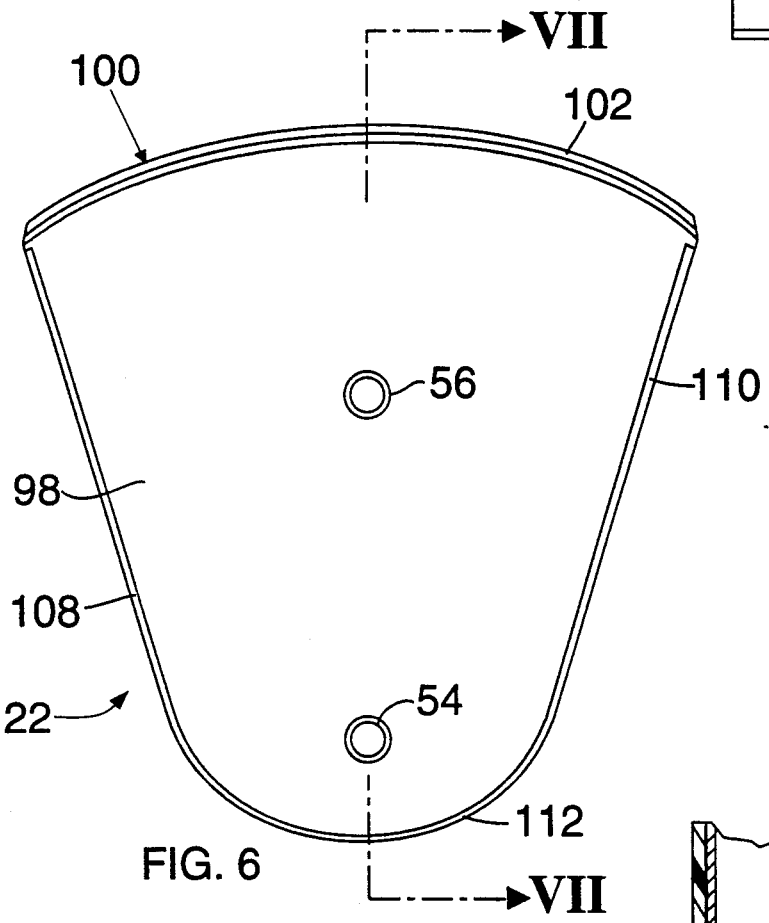
FIG. 6 is bottom view of a swimming pool support structure cap member shown in FIGS. 1 and 3.
Figure 8:
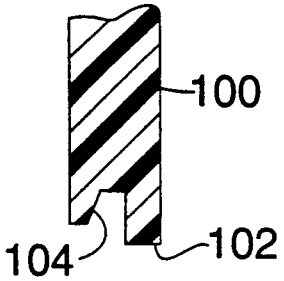
FIG. 8 is partial cross-sectional view, on an enlarged scale, of a portion of the cap member shown in FIG. 7.

Cap 22 is illustrated in detail in FIGS. 6, 7 and 8. Cap 22 includes a generally triangular main body 98 provided along an outer edge with a cylindrical downwardly extending flange 100 coaxial with sleeve 54. Along a circular rim 102, flange 100 is formed with a groove 104 for receiving a similarly profiled bead or ridge 106 along an upper edge of base 20 (FIG. 3). Groove 104 and bead 106 may be designed to cooperate in a releasable snap lock fit. Alternatively, rim 102 and the upper edge of base 20 may be provided with additional snap lock fasteners (not illustrated). Cap member is also provided with downwardly turned sides 108 and 110 and a rear flange 112 continuous with sides 108 and 110.

Figure 9:
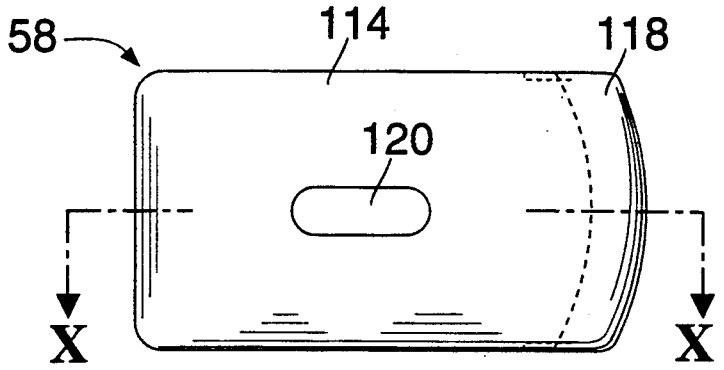
FIG. 9 is a top view of a protective element illustrated in FIG. 3.
Figure 10:
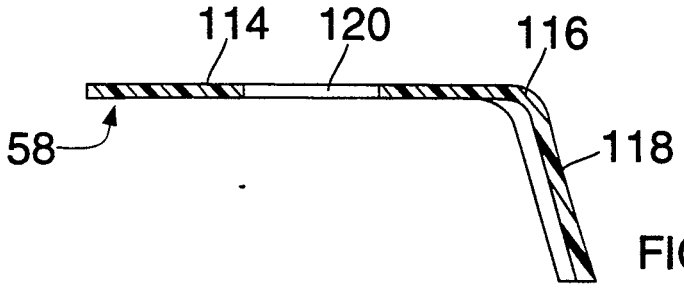
FIG. 10 is a cross-sectional view taken along line X—X in FIG. 9.

As shown in detail in FIGS. 9 and 10, visor-shaped protective member 58 includes a planar main body portion 114 connected at one end through a bend 116 to an arcuate shield portion 118. Body portion 114 is provided with a slot 120 traversed by pivot pin 52 in an assembled configuration of the swimming pool support structure 10, as illustrated in FIG. 3.

Figure 15:
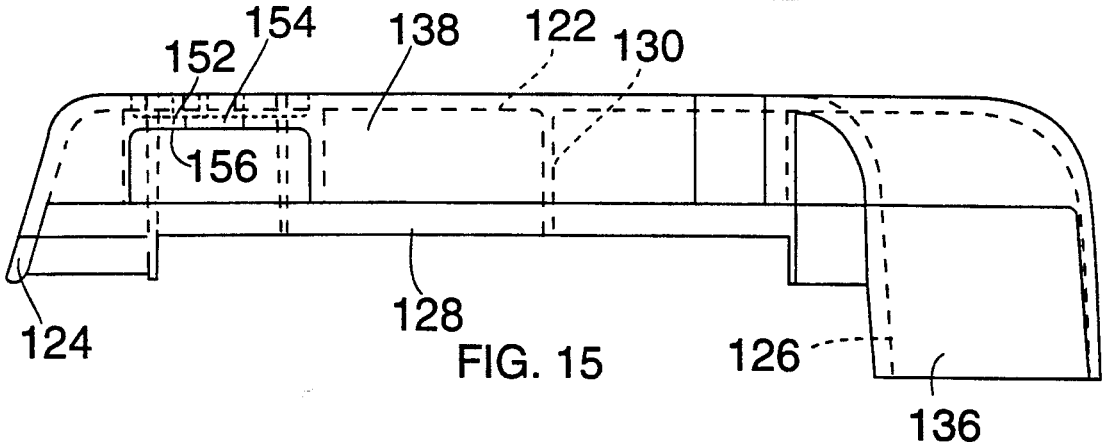
FIG. 15 is a side elevational view of the top rail member of FIG. 11, taken from the right side in FIG. 14.
Figure 11:
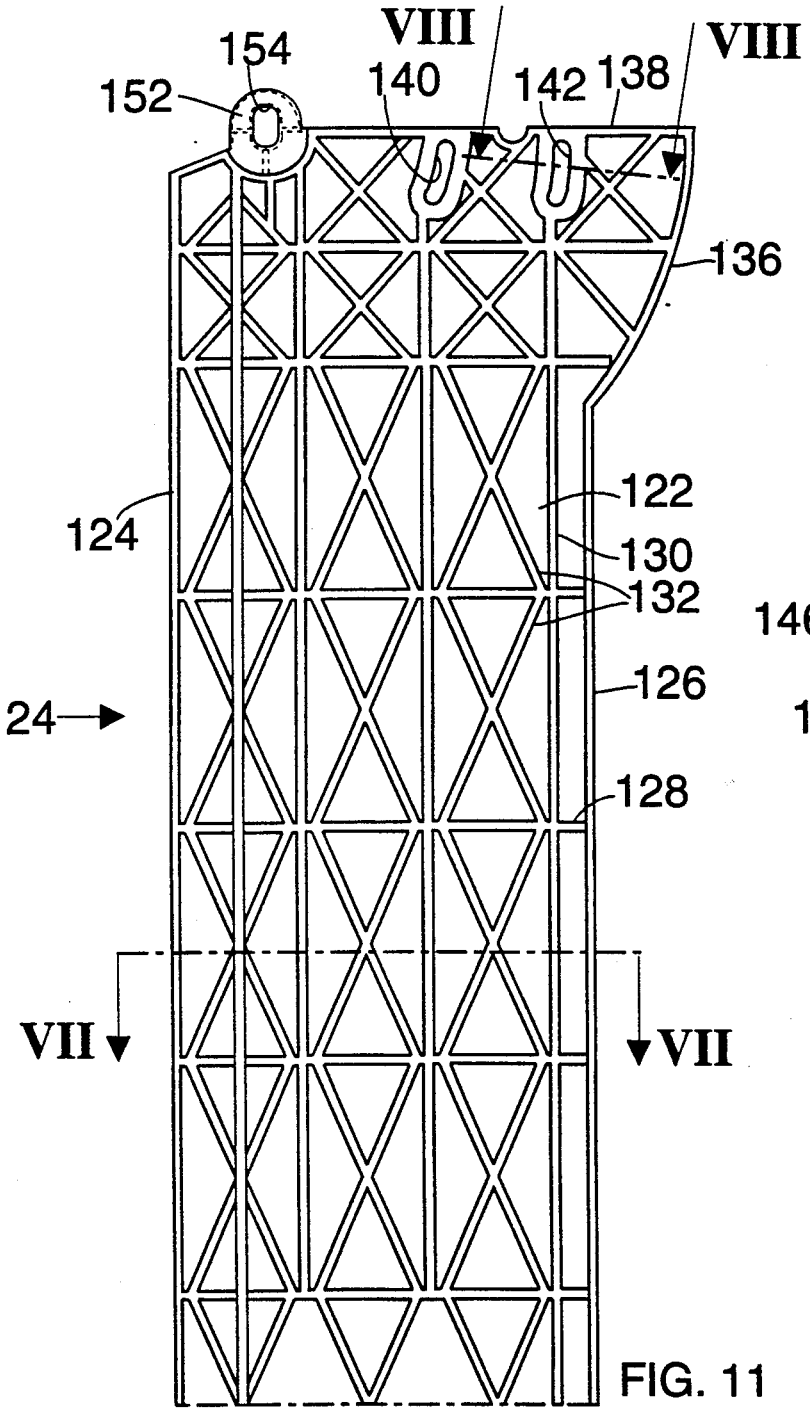
FIG. 11 is a partial bottom view of a top rail member illustrated in FIGS. 1 and 3.
Figure 12:
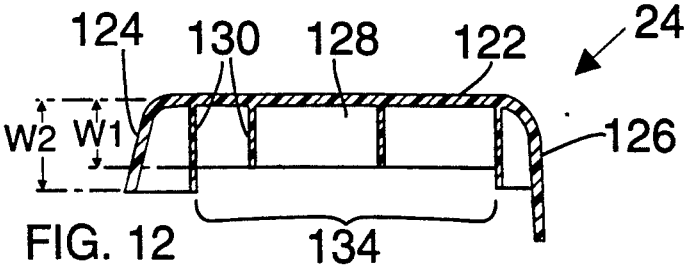
FIG. 12 is a partial cross-sectional view taken along line XII—XII in FIG. 11.
Figure 14:
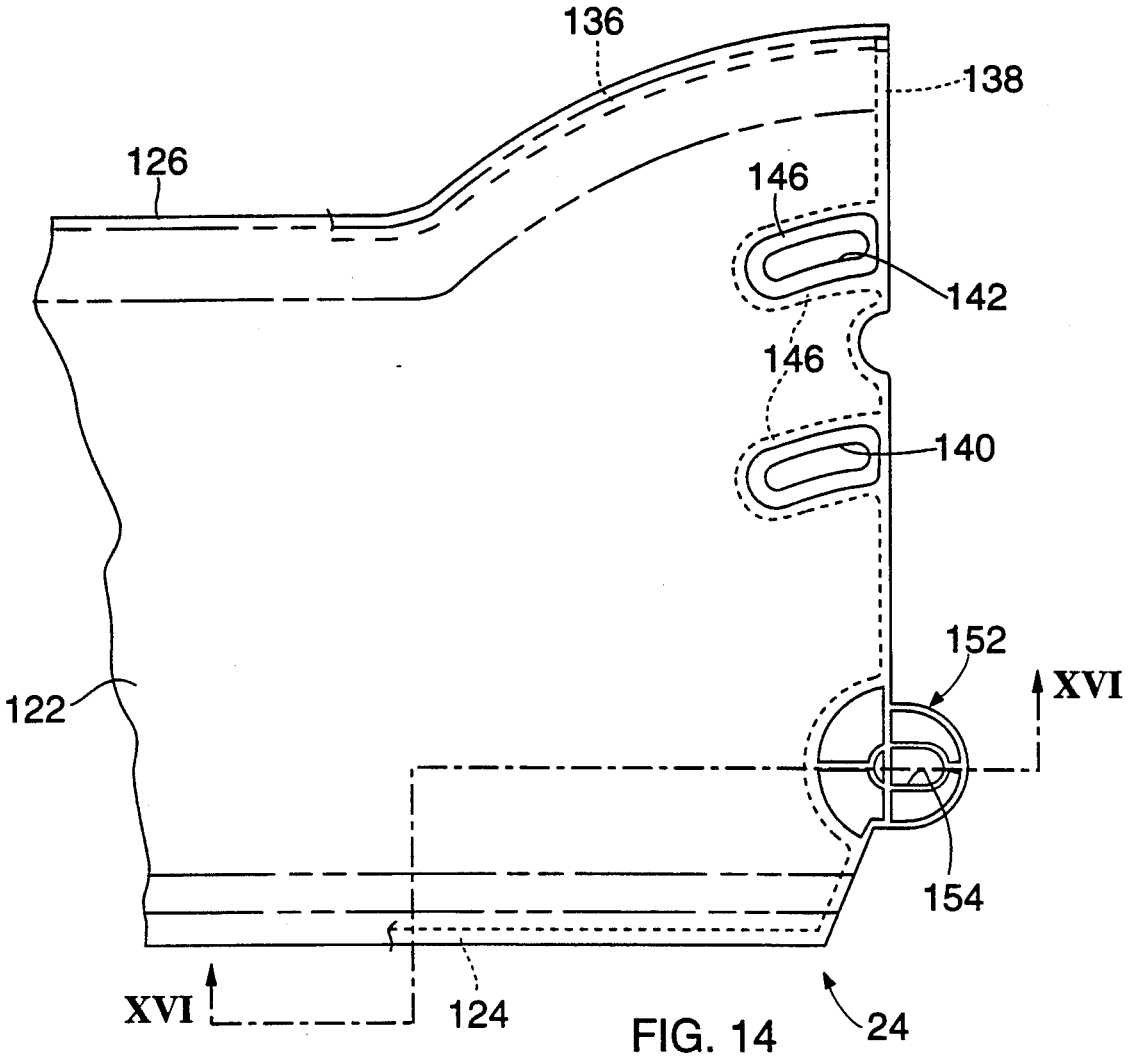
FIG. 14 is a top view, on an enlarged scale, of an end of the top rail member shown in FIG. 11.

As depicted in FIGS. 11, 12 and 15, top rail member 24 includes a planar plate 122 provided along its longitudinally extending sides with downwardly depending flanges 124 and 126. An undersurface of plate 122 is rigid with a reinforcement network comprising transversely extending webs 128, longitudinally extending webs 130 and diagonally extending webs 132. As best seen in FIG. 12, reinforcement webs 128, 130 and 132 located in a central region 134 of top rail member 24 have a smaller width w1 than the width w2 of reinforcement webs located proximately to flanges 124 and 126. The difference in widths w1 and w2 provides a recess in region 134 enabling a close juxtaposition of upper bar 26 (FIG. 1) to top rail member 24. Region 134 has a sufficient width, extending in a transverse direction, to accommodate upper bar 26 for pools having a range of different diameters.

As shown in FIGS. 11, 14, 15 and 16, an end of top rail member 24 is provided with a cylindrical wall 136 continuous with flange 126 and connected at an end opposite that flange with a transversely extending wall 138. Wall 136 has a radius of curvature slightly smaller than a radius of curvature of flange 100, whereby wall 136 can be positioned immediately inside flange 100.

Figure 13:
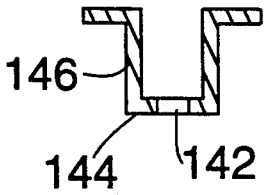
FIG. 13 is a partial cross-sectional view taken along line XIII—XIII in FIG. 11.
Figure 18:
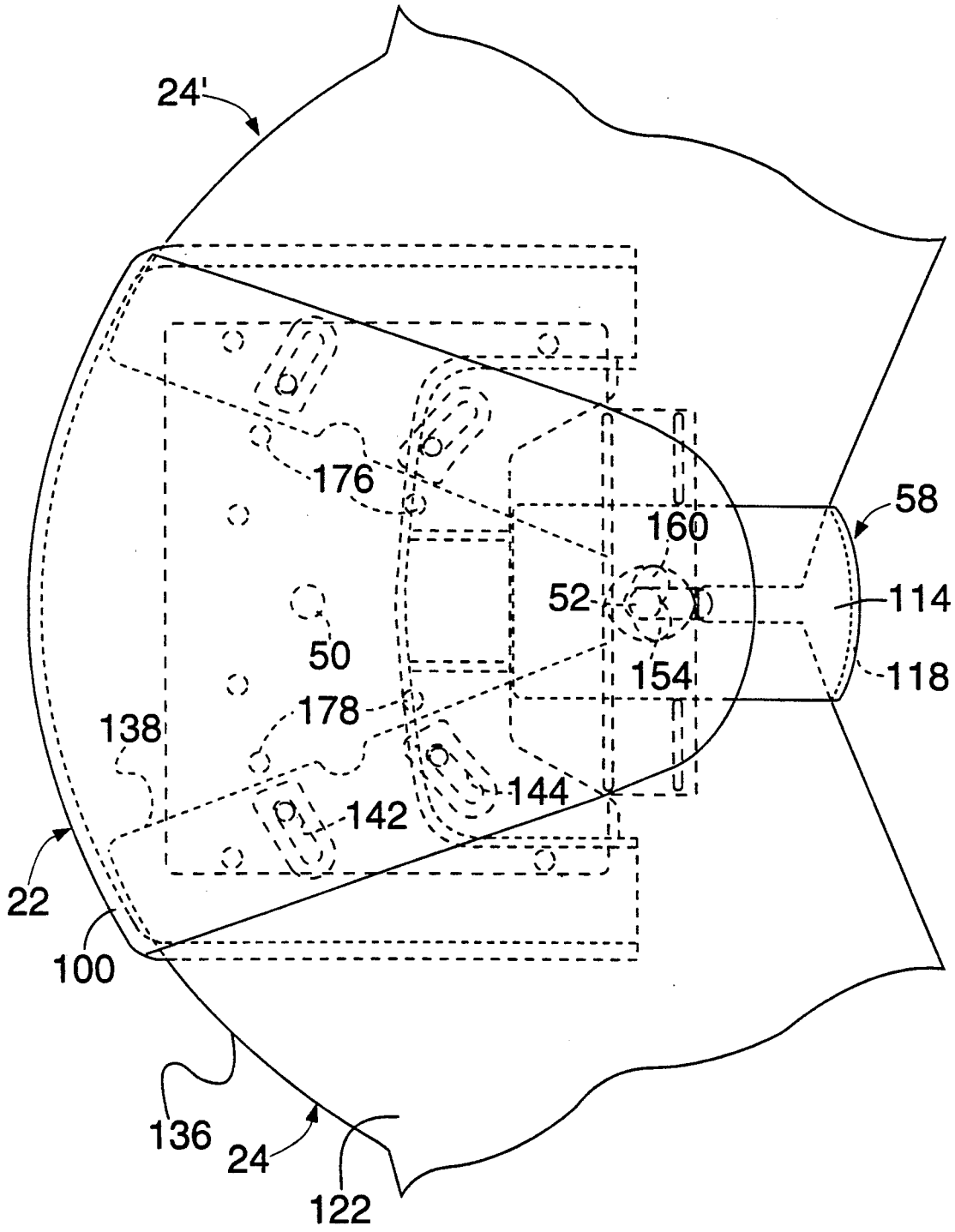
FIG. 18 is a partial top view of the swimming pool support structure of FIGS. 1 and 3, showing a pair of top rail members connected to an upright member.

Top rail member 24 is formed with a pair of arcuate slots 140 and 142 in a region about wall 138. As illustrated in FIG. 13, slot 142 is formed in the bottom wall 144 of a well 146 which contacts the upper surface of bearing plate 48 (FIGS. 3, 4 and 5) in an assembled state of swimming pool support structure 10 (FIGS. 3 and 18). Slot 140 is similarly formed. Fasteners such as bolts 148 and 150 (FIG. 3) traverse slots 140 and 142 and corresponding bores 94*b* and 94*a* (FIG. 5) in bearing plate 48 (FIG. 5) in the assembly of FIGS. 3 and 18.

Figure 16:
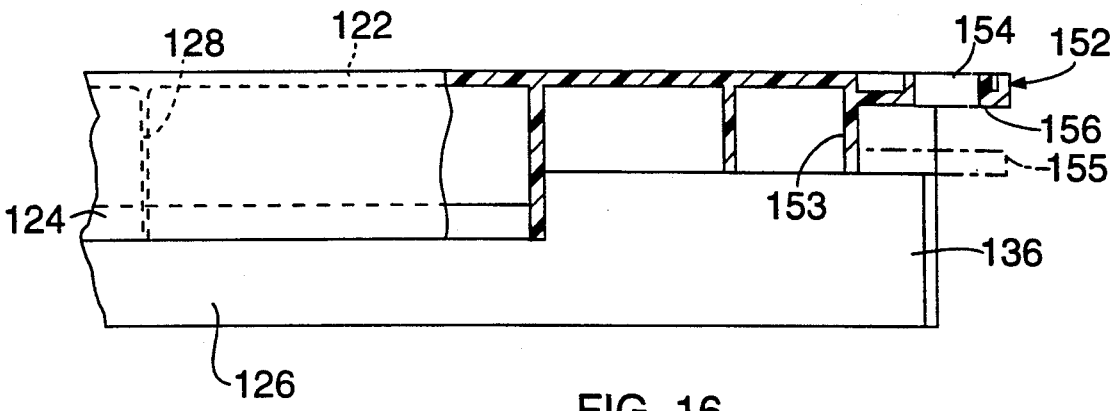
FIG. 16 is a partial elevational view and a partial cross-sectional view taken along line XVI—XVI in FIG. 14.

Top rail member 24 is further provided with a tongue 152 having an oval aperture or opening 154 Which is traversed by pivot pin 52 (FIGS. 3 and 18) in an assembled state of swimming pool support structure 10. As shown in FIGS. 15 and 16, tongue 152 is essentially coplanar with plate 122 of top rail member 24. Tongue 152 is formed with a flat lower surface 156. It is to be noted that tongue 152 may alternatively be formed at the bottom of a rib 153, as indicated in dot-dash lines 155. In that case, tongue 152 is formed on an upper side with a flat surface.

Figure 17:
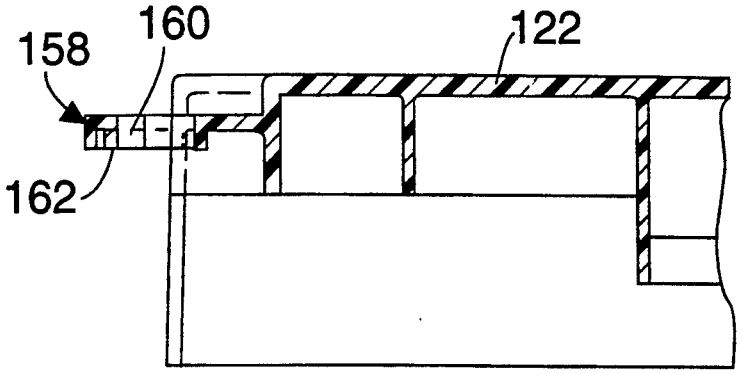
FIG. 17 is a partial elevational view and a partial cross-sectional view, similar to FIG. 16, of an opposite end of the top rail member shown in FIGS. 11.

A second end of top rail member 24 opposite the first end illustrated in FIGS. 11, 14, 15 and 16 is depicted in partial cross section in FIG. 17. That second end of the top rail member is essentially a mirror image of the first end, except that a tongue 158 is provided which is inwardly staggered with respect to plate 122. Tongue 158 is likewise provided with an oval aperture 160 and has a smooth upper surface 162. Surfaces 156 and 162 engage one another upon installation of the swimming pool support structure 10.

FIG. 18 shows a pair of top identical rail members 24 and 24' connected at opposite ends to pivot pin 52 via apertures 154 and 160 of tongues 152 and 158.

Figure 19:
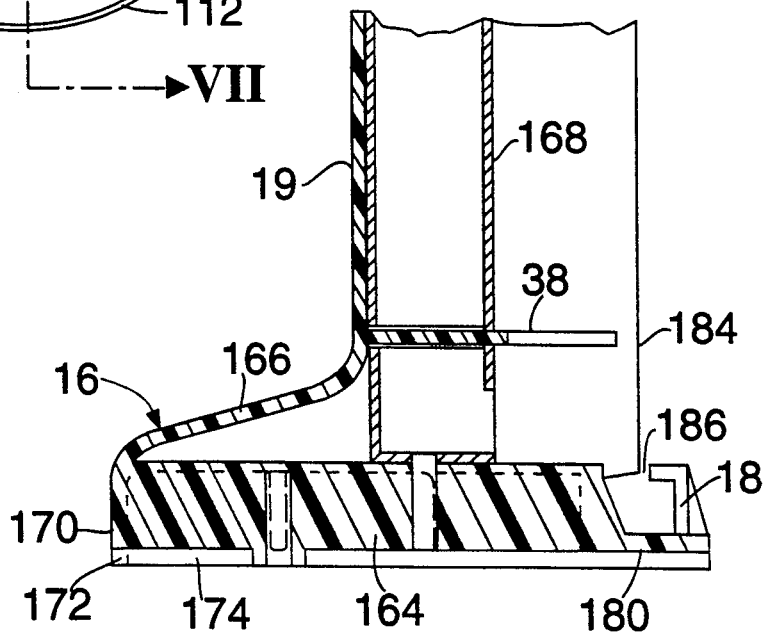
FIG. 19 is a partial cross-sectional view taken along line XIX—XIX in FIG. 2.

As shown in FIG. 19, foot portion 16 includes with a bearing plate component 164 integral with an external casing or shell 166 which is continuous with main body 1 of upright member 12. This is in contrast to conventional swimming pool support structures wherein the lower bearing plate is external to the upright, rather than internal as shown in FIG. 19, and is a separate piece requiring connection by bolts or other fastening elements.

As further illustrated in FIG. 19, upright member 12 advantageously incorporates a loading-bearing bearing post 168 which strengthens the upright and serves as a support for swimming pool railing 32. Railing posts 34 are connected through main body 19 to respective load-bearing posts 168 of respective upright members 12. The incorporation of load-bearing post 168 into upright member 12 of swimming pool support structure 10 enables the construction of foot portion 16, head portion 18 and main body 19 of moldable polymeric materials.

A forward or front skirt section 170 of casing or shell 166 is provided with a recess or cutout 172, while lower bearing plate 164 is provided with a shallow elongate slot 174. Recess 172 and slot 174 are traversed by a flat metal strap 279 (see FIG. 22) used for maintaining an oval pool in a non-circular configuration. The strap is connected to post 168 via an aperture (not shown) in main body 19 of upright member 12.

On a rearwardly facing side, foot portion 16 is formed with a radial extension 180 and an L-shaped finger 182 which defines, with vertical rear edges 184 of main body 19 a slot 186 for receiving pool wall 28.

In installing an above-ground swimming pool incorporating support structures 10, a first upright member 12 is erected at a desired location. Then an end of a first top rail member 24 (FIG. 18) is attached to pivot pin 52 by disposing tongue 152 (FIG. 17) over the pin so that slot 154 is aligned therewith. Upon lowering of top rail member 24 so that pivot pin 52 traverses slot 154, top rail member 24 is rotated so that a desired angle of orientation is attained between that top rail member and upper bearing plate 48. In particular, top rail member 24 is rotated until the transverse wall 138 thereof is aligned with an appropriate line segment 90. Upon attainment of the angle of orientation, top rail member 24 is temporarily fastened to bearing plate 48 of bearing member 38 by the insertion of bolts 148 and 150 through slots 140 and 142 and bores 96*b* and 96*a*. The attachment of this first top rail member 24 to the first upright member 12 is temporary because, upon the completion of a circle of uprights and top rails, tongue 158 of the last top rail member 24 must be positioned underneath tongue 152 of the first top rail member 24.

It is to be noted that bearing plate 48 is preferably provided with several pairs of bores as indicated at 170 and 178 in FIG. 18, for facilitating the installation of pools of different diameters with the same swimming pool support structures 10.

Upon the temporary attachment of the first top rail member 24 to the first upright member 12, a second upright member 12 is erected at a second end of the first top rail member 24 opposite the temporarily attached end. The second end of the first top rail member 24 is fastened to the second upright member at the respective pivot pin 52, the second upright member 12 being rotated so that it has the correct orientation with respect to the first top rail member 24, as determined via alignment of wall 138 with line segments 92. Upon the securing of the first top rail member 24 to the second upright member 12 via bolts 148 and 150 (FIG. 3), a second top rail member is attached and oriented with respect to the second upright member, as described hereinabove with reference to the first top rail member 24 and the first upright member 12.

The procedure described above is then repeated, until a circular array of swimming pool support structures 10 all connected to one another is assembled.

The installation of the other components of the swimming pool support structure 10, such as cap 22, protective member 58, pool wall 28, and bars 26 and 30, is considered to be self evident from the structural description above.

Figure 20:
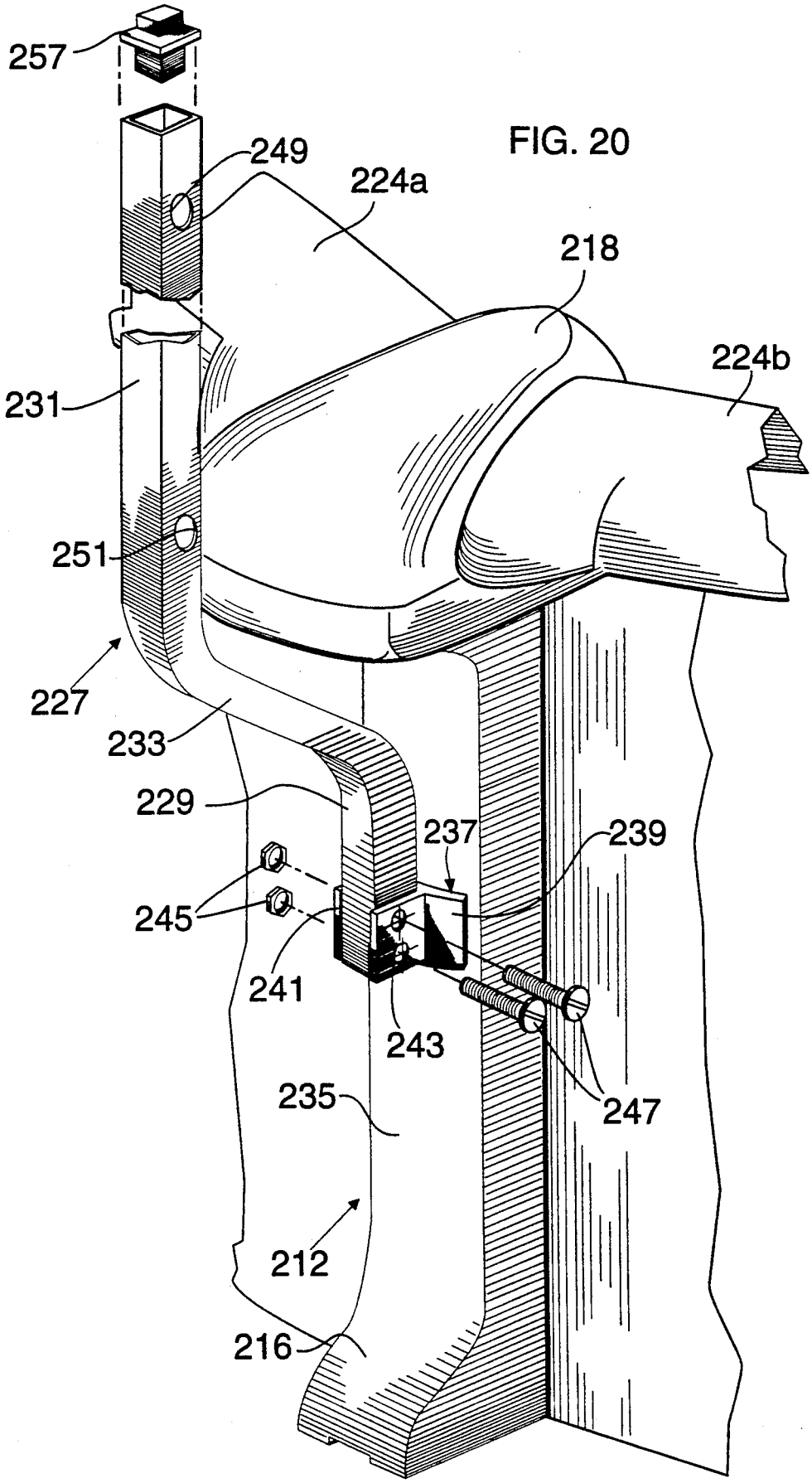
FIG. 20 is a partially exploded perspective view of an upright member with a fence support post in accordance with the present invention.

FIG. 20 illustrates an upright member 212 with an integral foot portion 216 and a rounded head portion 218. As described hereinabove particularly with reference to FIG. 18, two top rail members **224*a* and 224*b* are previously connected to upright member 212 at head portion 218 and then locked into a relative orientation determined basically by pool size. The orientation between top rail members 224*a* and 224*b* will be the same for each head portion 218** along the periphery of the respective pool in the event that the pool is circular. If the pool is oval, then the orientation angle between adjacent or consecutive top rail members in a flattened region of the pool will be greater than in the rounded areas of the pool. More specifically, at least two such top rail members will exhibit an angle of 180° with respect to one another.

As shown in FIG. 20, a fence post 227 is provided which has a straight lower end segment 229, a straight upper end segment 231 parallel thereto and a straight middle segment 233. Middle segment 233 is disposed at an angle with respect to end segments 229 and 231, whereby those end segments are staggered with respect to one another to enable a mounting of lower end segment 229 directly to upright member 212 at a point below head portion 218 while enabling upper end segment 231 to be laterally disposed relative to the head portion. Lower end segment 229 is attached to a curved wall 235 of upright member 212 via a mounting bracket 237 including an arcuate plate 239 engageable with curved wall 235 and further including a pair of parallel plates 241 and 243 rigid with arcuate plate 239. A pair of nuts 245 and bolts 247 connect lower end segment 229 to bracket plates 241 and 243.

Upper end segment 231 of fence post 227 is formed with holes 249 and 251 for receiving upper and lower fence rails 253 and 255 (FIG. 1). A plug 257 is provided for closing off an upper end of upper end segment 231.

Figure 21:
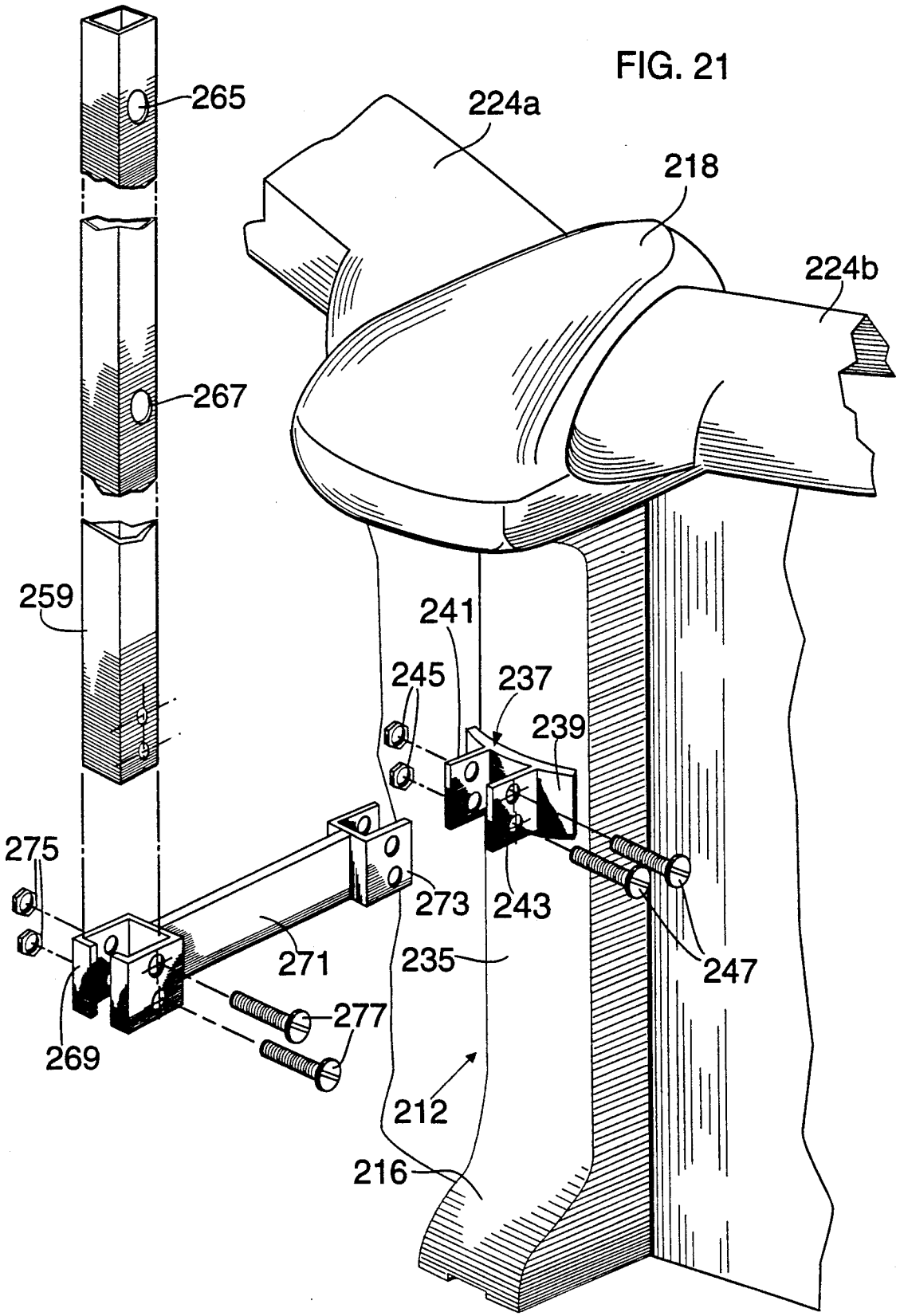
FIG. 21 is a partially exploded perspective view of the upright member of FIG. 20 with another fence support post in accordance with the present invention.

An alternative fence post 259 for use with upright member 212 is illustrated in FIG. 21, together with a mounting assembly 261. Fence post 259 is an elongate straight rectangular profile 263 provided with holes 265 and 267 for receiving upper and lower fence rails 253 and 255 (FIG. 1). In addition, fence post 259 may be provided with plug 257 (see FIG. 20) for closing off an upper end of the profile.

Mounting assembly 261 includes a rectangular slotted sleeve 269, an elongate bar 271 connected at one end to the slotted sleeve, and a channel member 273 connected to the elongate bar at an end opposite slotted sleeve 269. Channel member 273 is fastened to curved wall 235 of upright member 212 via mounting bracket 237 (see also FIG. 20) and nuts 245 and bolts 247. A further pair of nuts 275 and 277 and bolts couple the lower end of post 259 to slotted sleeve 269.

It is to be noted that curved wall 253 of upright member 212 is preferably a thin walled section provided in the region about mounting bracket 237 with a thickened reinforcement (not illustrated) for receiving screws (not shown) which fasten bracket 237 to wall 253. The thickened reinforcement is preformed with holes for receiving the screws, while wall 253 is provided with a thin pierceable membrane (not depicted) over the preformed holes.

Figure 22:
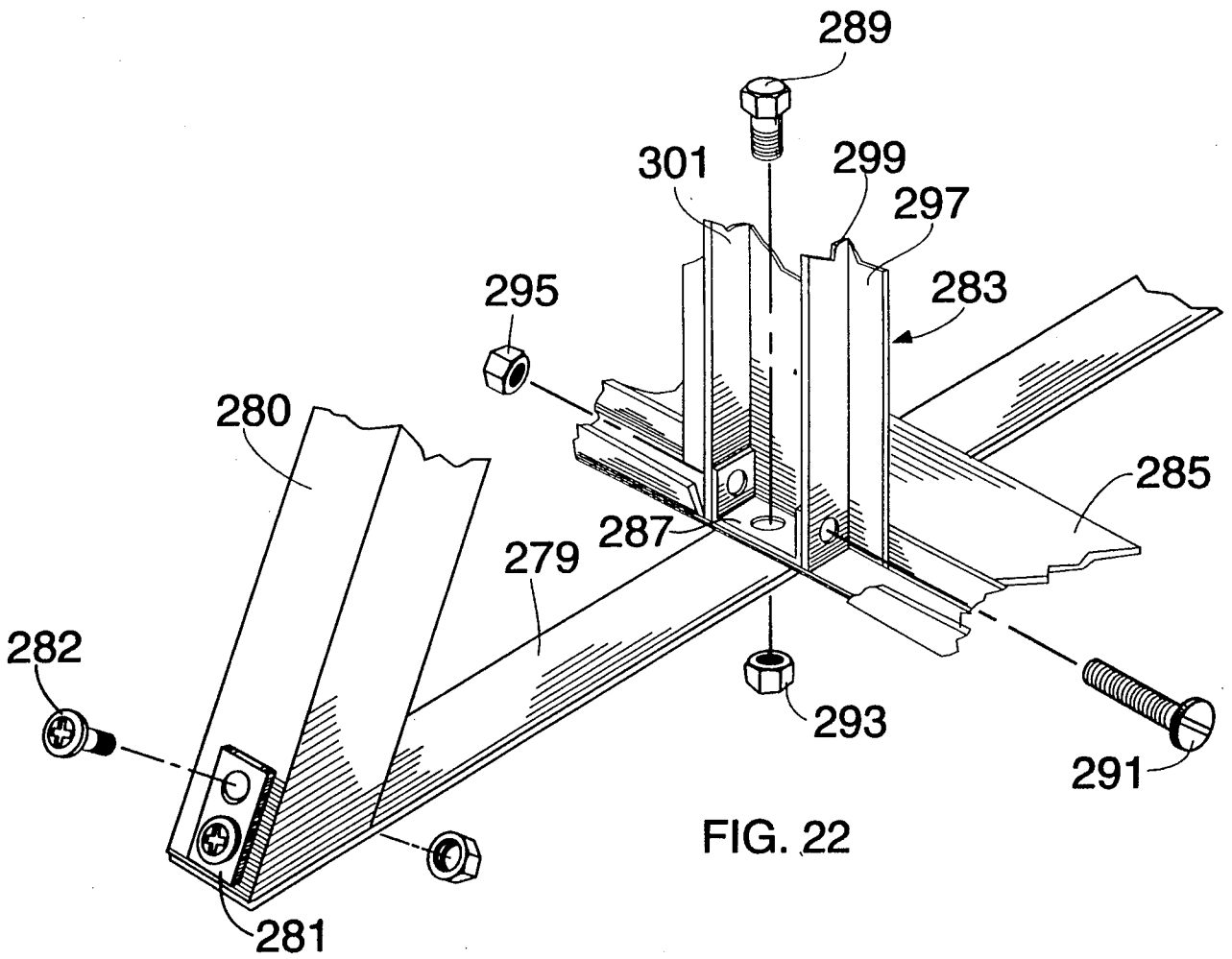
FIG. 22 is a partially exploded, partial perspective view showing a strap member and buttress upright for forming and maintaining an oval pool.

As shown in FIG. 22, strap member 279, which extends beneath a swimming pool, is connected at an outer end to a lower end of a buttress brace member 280 by means of a strap angle 281 and bolts 282. At an upper end, buttress brace 280 extends through an opening in straight main body 19 of upright member 12 of in wall 253 of upright member 212. The upper end of buttress brace 280 is connected to post 168 (FIG. 19) or to a buttress upright 283 partially shown in FIG. 22. At a lower end, buttress upright 283 is fastened to strap member 279 and to an oval-pool bottom rail 285 via a U-shaped bracket 287, together with bolts 289 and 291 and nuts 293 and 295. Buttress upright 283 includes a main plate 297 and a pair of parallel reinforcement plates 299 and 301 connected thereto.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are preferred by way of example to facilitate comprehension of the invention and should not be construed to limit the scope thereof.

What is claimed is:

1. A swimming pool support structure comprising:

an elongate upright member having a longitudinal axis, said upright member including a hollow casing made of polymeric material and a load-bearing member disposed inside said casing;

a bearing plate member attached to one end of said upright member, said bearing plate member extending essentially orthogonally with respect to said axis;

a pivot pin attached at least indirectly to said upright member at said bearing plate and extending in a direction parallel to said axis;

an elongate top rail member provided at opposite ends with a pair of holes each having a diameter greater than a diameter of said pin, said pin traversing one of said holes so that said top rail member is pivotably attached to said upright member at said pin; and fastening means for fixing said top rail member to said upright member upon the attainment of a desired orientation angle of said top rail member with respect to said bearing plate.

2. The support structure recited in claim 1 wherein said bearing plate constitutes an upper bearing plate, further comprising a lower bearing plate and a hollow foot member attached to an end of said upright member opposite said upper bearing plate, said lower bearing plate being disposed inside said hollow foot member.

3. The support structure recited in claim 2 wherein said foot member is provided in a forward facing skirt section with a cutout traversable by a strap member.

4. The support structure recited in claim 1, further comprising a head section and a foot section each attached to said casing and forming a continuous outer surface therewith, said bearing plate being mounted in said head section, further comprising a cap member releasably attached to said head section to form a continuous outer surface therewith.

5. The support structure recited in claim 4 wherein said head section and said foot section are releaseably attached to said casing.

6. The support structure recited in claim 4, further comprising attachment means for releasably attaching said cap member to said head section, said attachment means including mating projections on said cap member and said bearing plate.

7. The support structure recited in claim 6 wherein one of said mating projections is constituted by said pin.

8. The support structure recited in claim 1 wherein said fastening means includes a slot on one of said bearing plate and said top rail member, an aperture on the other of said bearing plate and said top rail member, and an elongate fastener element traversing both said slot and said aperture.

9. The support structure recited in claim 1, further comprising a cap member and attachment means on said cap member for securing same to said upright member at an end thereof carrying said bearing plate.

10. The support structure recited in claim 9 wherein said top rail member is provided at said opposite ends with circularly arcuate edge portions, said cap member being provided with a circularly arcuate inner surface having a radius larger than a common radius of said edge portions.

11. The support structure recited in claim 1, further comprising an upper rod member and a lower rod member each provided with a respective longitudinal groove for receiving an edge of a pool-wall sheet material, also comprising means for securing said upper rod member and said lower rod member to said upright member.

12. The support structure recited in claim 11 wherein said means for securing includes a channel element for receiving said upper rod member.

13. A swimming pool support structure comprising:

an upright member including an internal load bearing component and an external decorative casing, said load-bearing member being disposed in said casing;

a foot member attached to said casing at one end thereof and forming a continuous outer surface therewith;

a first bearing plate disposed inside said foot member;

a head member attached to said casing at an end thereof opposite said foot member, said head member forming a continuous outer surface with said casing;

a second bearing plate disposed inside said head member; and a cap member releasably attached to said head member to form a continuous external surface therewith, said cap member covering said second bearing plate.

14. The support structure recited in claim 13 wherein said second bearing plate is provided with a bearing pin for enabling attachment of a swimming pool top rail member to said bearing plate at a selectable orientation angle with respect to said bearing plate.

15. The support structure recited in claim 14, further comprising marking means on said second bearing plate for facilitating the selection of said orientation angle in accordance with a desired pool size.

16. The support structure recited in claim 15, further comprising fastening means for fixing said top rail member to said upright upon the attainment of a selected orientation angle of said top rail member with respect to said bearing plate.

17. The support structure recited in claim 16 wherein said fastening means includes a slot on one of said bearing plate and said top rail member, an aperture on the other of said bearing plate and said top rail member, and an elongate fastener element traversing both said slot and said aperture.

18. The support structure recited in claim 13, further comprising attachment means for releasably attaching at least one of said foot member and said head member to said casing.

19. The support structure recited in claim 13 wherein said first bearing plate is spaced from a bottom rim of said foot member.

20. The support structure recited in claim 13 wherein said foot member is provided in a forward facing skirt section with a cutout traversable by a strap member.

21. The support structure recited in claim 20, further comprising a strap member traversing said cutout and a strut connecting said strap to said load-bearing component through an aperture in said casing.

22. The support structure recited in claim 13 wherein said cap member is attached to said second bearing plate via two pairs of mating projections on said cap member and said second bearing plate.

23. The support structure recited in claim 13, further comprising attachment means on said casing for attaching a pool fence post to said casing.

24. The support structure recited in claim 13, further comprising an upper rod member and a lower rod member each provided with a respective longitudinal groove for receiving an edge of a pool-wall sheet material, also comprising means for securing said upper rod member and said lower rod member to said upright member.

25. The support structure recited in claim 24 wherein said means for securing includes a channel element for receiving said upper rod member.

26. A swimming pool support structure comprising:

an elongate upright member having a longitudinal axis;

pivot means attached at least indirectly to said upright member at one end thereof for defining an axis of rotation extending in a direction parallel to said longitudinal axis;

an elongate top rail member provided at an end with connector means for pivotably connecting said top rail member to said upright member at said pivot means, said top rail member being formed on an underside with a network of ribs, said top rail member having a central region extending essentially along the length of said top rail member, said ribs in said central region being smaller in width than ribs outside said central region, whereby swimming pool side walls of different diameters may be accommodated;

fastening means for fixing said top rail member to said upright member upon the attainment of a desired orientation angle of said top rail member with respect to said upright member;

horizontal support means for providing a horizontally oriented support surface, said support means being attached to said upright member.

27. The support structure recited in claim 26 wherein said horizontal support means takes the form a bearing plate member attached to one end of said upright member, said bearing plate member extending essentially orthogonally with respect to said axis.

28. The support structure recited in claim 27 wherein said pivot means takes the form of a pivot pin attached at least indirectly to said upright member at said bearing plate.

29. The support structure recited in claim 28 wherein said connector means takes the form of a pair of holes each having a diameter greater than a diameter of said pin, said pin traversing one of said holes so that said top rail member is pivotably attached to said upright member at said pin.

30. The support structure recited in claim 26 wherein said fastening means includes a screw fastener.

31. A swimming pool support structure comprising:

an elongate upright member having a longitudinal axis;

a bearing plate member attached to one end of said upright member, said bearing plate member extending essentially orthogonally with respect to said axis;

a pivot pin attached at least indirectly to said upright member at said bearing plate and extending in a direction parallel to said axis;

an elongate top rail member provided at opposite ends with a pair of holes each having a diameter greater than a diameter of said pin, said pin traversing one of said holes so that said top rail member is pivotably attached to said upright member at said pin;

fastening means for fixing said top rail member to said upright member upon the attainment of a desired orientation angle of said top rail member with respect to said bearing plate; and marking means on said bearing plate for facilitating selection of said orientation angle in accordance with a desired pool size.

32. The support structure recited in claim 31 wherein said marking means includes linear marker elements on said bearing plate.

* * * * *